United States Patent [19]

Keeton

[11] Patent Number: 4,738,210

[45] Date of Patent: Apr. 19, 1988

[54] BACKLATCH ATTACHMENT WITH A ROTATABLE THREAD CATCHER

[76] Inventor: J. Herbert Keeton, 747 Meader St., Box 296, Campbellsville, Ky. 42718

[21] Appl. No.: 933,884

[22] Filed: Nov. 24, 1986

Related U.S. Application Data

[63] Continuation-in-part of Ser. No. 866,561, May 23, 1986, Pat. No. 4,679,515.

[51] Int. Cl.[4] ..... D05B 65/06

[52] U.S. Cl. ..... 112/262.1; 112/286; 112/288; 112/253

[58] Field of Search ..... 112/318, 288, 130, 291, 112/298, 262.1, 271, 276, 277, 287, 286, 253, 301, 279, 289; 226/153; 271/119; 242/18 PW

[56] References Cited

U.S. PATENT DOCUMENTS

| | | | |
|---|---|---|---|
| 1,472,964 | 11/1923 | Donnell et al. | 226/153 |
| 2,955,553 | 10/1960 | Winberg | 112/318 |
| 3,590,758 | 7/1971 | Hughes | 112/288 X |
| 3,699,907 | 10/1972 | Anderson et al. | 112/130 X |
| 3,712,256 | 1/1973 | Striegler et al. | 112/288 |
| 3,924,554 | 12/1975 | Cummins | 112/287 |
| 4,038,933 | 8/1977 | Marforio | 112/288 |
| 4,108,097 | 8/1978 | Gross et al. | 112/288 |
| 4,141,303 | 2/1979 | Scott et al. | 112/301 |
| 4,149,478 | 4/1979 | Sanvito et al. | 112/286 |
| 4,152,995 | 5/1979 | Klundt | 112/318 |
| 4,187,793 | 2/1980 | Fietta et al. | 112/288 |
| 4,220,105 | 9/1980 | Palacino | 112/287 |
| 4,303,030 | 12/1981 | Palacino et al. | 112/288 |
| 4,453,481 | 6/1984 | Garnett et al. | 112/288 |
| 4,470,362 | 9/1984 | Kear | 112/276 |
| 4,477,034 | 10/1984 | Oswald | 242/18 PW |
| 4,523,535 | 6/1985 | Blackburn | 112/288 |
| 4,607,583 | 8/1986 | Biermann et al. | 112/288 X |
| 4,679,515 | 7/1987 | Keeton | 112/262.1 |

FOREIGN PATENT DOCUMENTS

| | | | |
|---|---|---|---|
| 2058858 | 4/1981 | United Kingdom | 112/288 |

*Primary Examiner*—Andrew M. Falik

*Attorney, Agent, or Firm*—Nixon & Vanderhye

[57] ABSTRACT

An attachment for a semi-automatic sewing machine ensures that any excess thread chain extending from the leading or trailing edge of a garment during an operation on the garment with the sewing machine, is stitched directly to the garment so that no loose or free ends of thread chain are provided. The completion of stitching by the sewing machine of a first garment is sensed and the first garment is engaged in response to the sensing by a rubber wheel which moves the garment away from the stitching needle more quickly than the sewing machine stitches the stitch chain. The excess thread chain is automatically severed by a movable plate rotating with respect to a stationary plate, and the excess severed thread chain is automatically positioned by an air blower in association with a rotatable thread catcher so that excess thread chain is stitched to the second garment by the sewing machine. The rotatable thread catcher comprises a tapered wheel with a serrated ring catching thread blown onto the wheel. The wheel has recesses which cooperate with the blower to spin the wheel, a one-way clutch allowing rotation in only one direction.

20 Claims, 2 Drawing Sheets

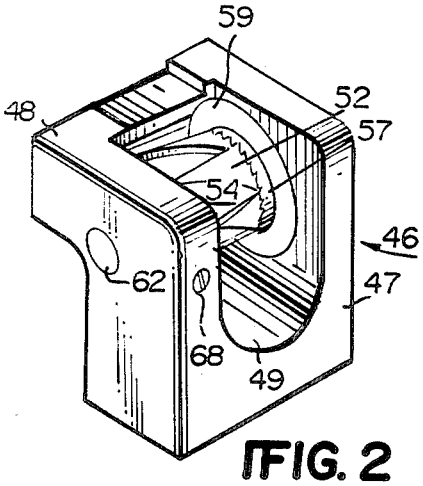
FIG. 2
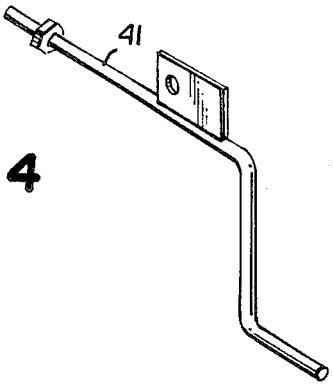
FIG. 4
FIG. 3
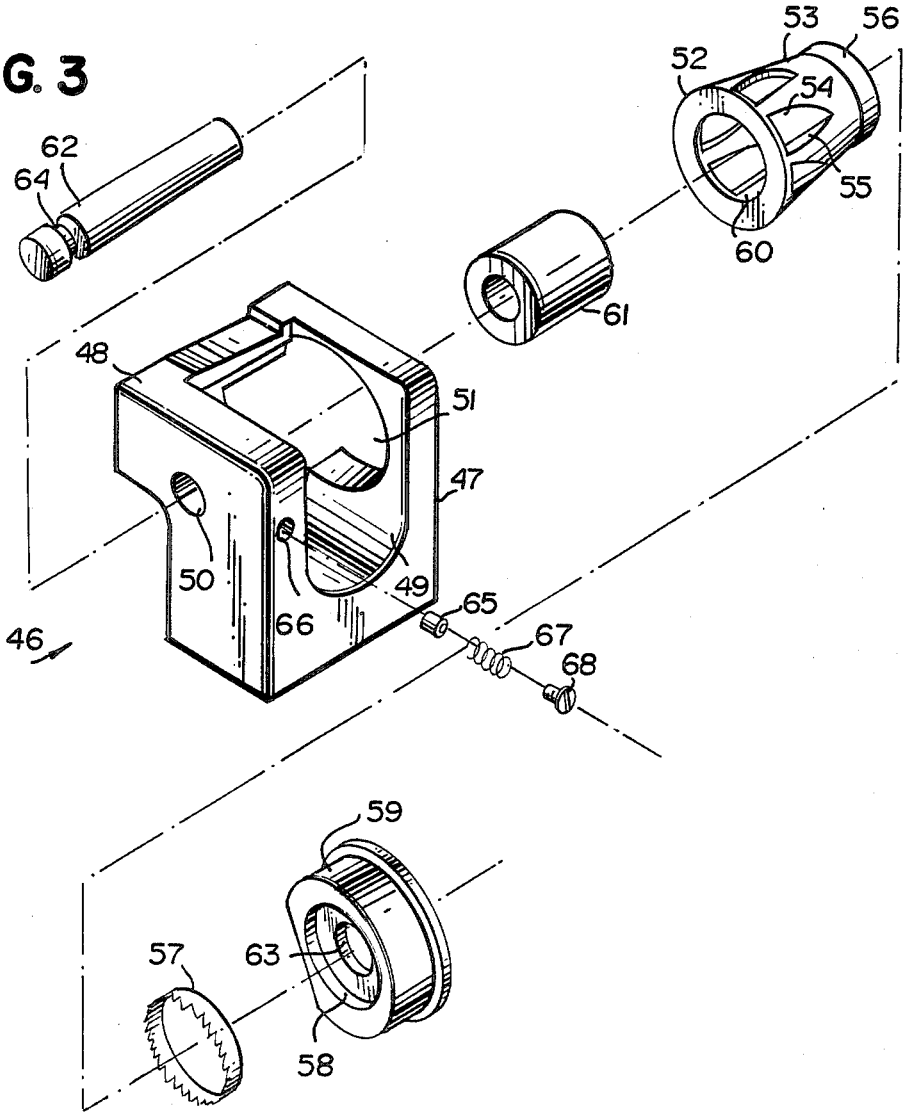

BACKLATCH ATTACHMENT WITH A ROTATABLE THREAD CATCHER

CROSS-REFERENCE TO RELATED APPLICATION

This application is a continuation-in-part of co-pending U.S. application Ser. No. 866,561, filed May 23, 1986 U.S. Pat. No. 4,679,515.

BACKGROUND OF THE INVENTION

When sewing garments, or other articles, with semi-automatic sewing machines, and when the sewing of one garment has been completed and an operator lets up on the foot pedal for controlling the sewing machine, it takes a significant period of time before the automatic sewing machine stops stitching a thread chain. During the time that the needle of the sewing machine is still moving, but stretching of the garment has been completed, a thread chain about 1 to 1½ inches in length may be formed. While conventionally the thread chain can be severed so that not too long a portion thereof extends from the rear of the garment, when sewing has restarted on a second garment the thread chain often extends from the front of the second garment and spoils the appearance of the garment. Therefore, in the conventional commercial practice, the thread chain must be cut off manually, resulting in labor costs that are higher than desirable and disrupting the ability to automate the garment handling operation.

It has been recognized in the art that it is desirable to fold back the chain stitching so that it will be stitched onto the trailing garment, as exemplified by U.S. Pat. No. 4,038,933. However, heretofore there have been a number of practical difficulties associated with producing commercial machines to successfully perform that function, and at the present time, there are no known commercial machines in widespread use which perform the folding back and stitching function.

SUMMARY OF THE INVENTION

According to the present invention an attachment for an automatic sewing machine, and a method of automatically stitching excess thread chain are provided which result in practical and effective stitching of excess thread chain to a subsequent garment. The attachment and the method according to the present invention are completely automatic so that no operator intervention is necessary; in fact, the operator need not even let up on the foot pedal for controlling the semi-automatic sewing machine once the stitching has been completed.

According to one aspect of the present invention, an attachment is provided for a semi-automatic sewing machine having a stitching needle for stitching a thread chain, a presser foot, and a power source. The attachment comprises the following components: a means for sensing the completion of stitching by the sewing machine of a first garment, by sensing the trailing portion of the first garment; a means for automatically engaging the first garment in response to the sensing and moving the first garment away from the stitching needle more quickly than the sewing machine stitches the thread chain, to pull excess thread chain extending past the trailing portion of the first garment relatively taut; a means for automatically severing the excess thread chain from the trailing portion of the first garment when the excess thread chain is relatively taut; and a means for automatically positioning the excess thread chain with respect to a second garment so that the excess thread chain is stitched to the second garment by the sewing machine.

The means for automatically engaging the first garment preferably comprise a wheel having the garment engaging portions thereof of rubber, or another elastic material. The wheel is rotated about an axis perpendicular to the direction of garment movement, and cooperates with the flat surface of the sewing machine to propel the garment away from the needle when an arcuate circumferential portion of the wheel (about 270° of its circumference) is above the surface. Once the cut out (scalloped) portions of the wheel periphery are above the surface, however, the wheel no longer engages the garment even though it continues rotation. At that point the excess thread chain is taut.

The automatic severing means preferably comprises the stationary plate having an edge, the plate disposed between the stitching needle and the wheel. A rotatable plate having an edge cooperating with the edge of the stationary plate is rotated by a shaft to effect severing. A linear actuator is connected to the shaft to effect the rotation.

The means for automatically positioning the excess thread chain comprises a first air jet which blows the thread chain from its severing position to a position on the opposite side of the stitching needle. A second air jet blows the thread chain onto a tapered catching wheel where the thread engages a serrated ring mounted on one end of the wheel. A third air jet supplies air under pressure to maintain the thread in contact with the serrated ring until it is snagged by the serrations. A fourth air jet delivers air under pressure to surface indentations provided on the tapered wheel to impart rotational movement thereto so as to tension the thread chain. Since the fourth air jet supplies air under pressure in the form of a single instantaneous pulse, after a thread is made taut it is free to be gradually released in the opposite direction as the thread chain is stitched into the next garment by the sewing machine. Braking means are provided to regulate the force required to rotate the catching wheel.

The invention also comprises the individual components of the attachment as described above, which may cooperate with other types of components for performing the same function as the preferred components according to this invention.

The invention also relates to a method of automatically stitching access thread chain to a cloth so that no free stitches are provided on the leading edge of the cloth. The method generally comprises the steps of: (a) automatically sensing the completion of stitching, by the sewing machine, of a first cloth, by sensing a trailing portion of the first cloth; (b) automatically engaging the first cloth in response to the sensing and moving the first cloth away from the stitching needle more quickly than the sewing machine stitches the thread chain, to pull excess thread chain extending past the trailing portion of the first cloth relatively taut; (c) automatically severing the excess thread chain from the trailing portion of the first garment when the excess thread chain is relatively taut, and (d) automatically positioning the excess thread chain with respect to a second cloth so that the excess thread chain is stitched to the second cloth by the sewing machine, so that neither cloth has free stitches extending therefrom.

It is the primary object of the present invention to provide a simple, effective, and practical method and attachment (including components thereof) for automatically stitching excess thread chain to a trailing cloth in the operation of a semi-automatic sewing machine. This and other objects of the invention will become clear from an inspection of the detailed description of the invention and from the appended claims.

BRIEF DESCRIPTION OF THE DRAWINGS

FIG. 2 is a detailed perspective view of the exemplary thread catching means according to the present invention;

FIG. 3 is an exploded view of the components which make up the catching means assembly illustrated in FIG. 2; and FIG. 4 is a detailed perspective view of an air jet supply conduit for supplying air under pressure to an excess thread chain at a severing station.

DETAILED DESCRIPTION OF THE DRAWINGS

Figure 1:
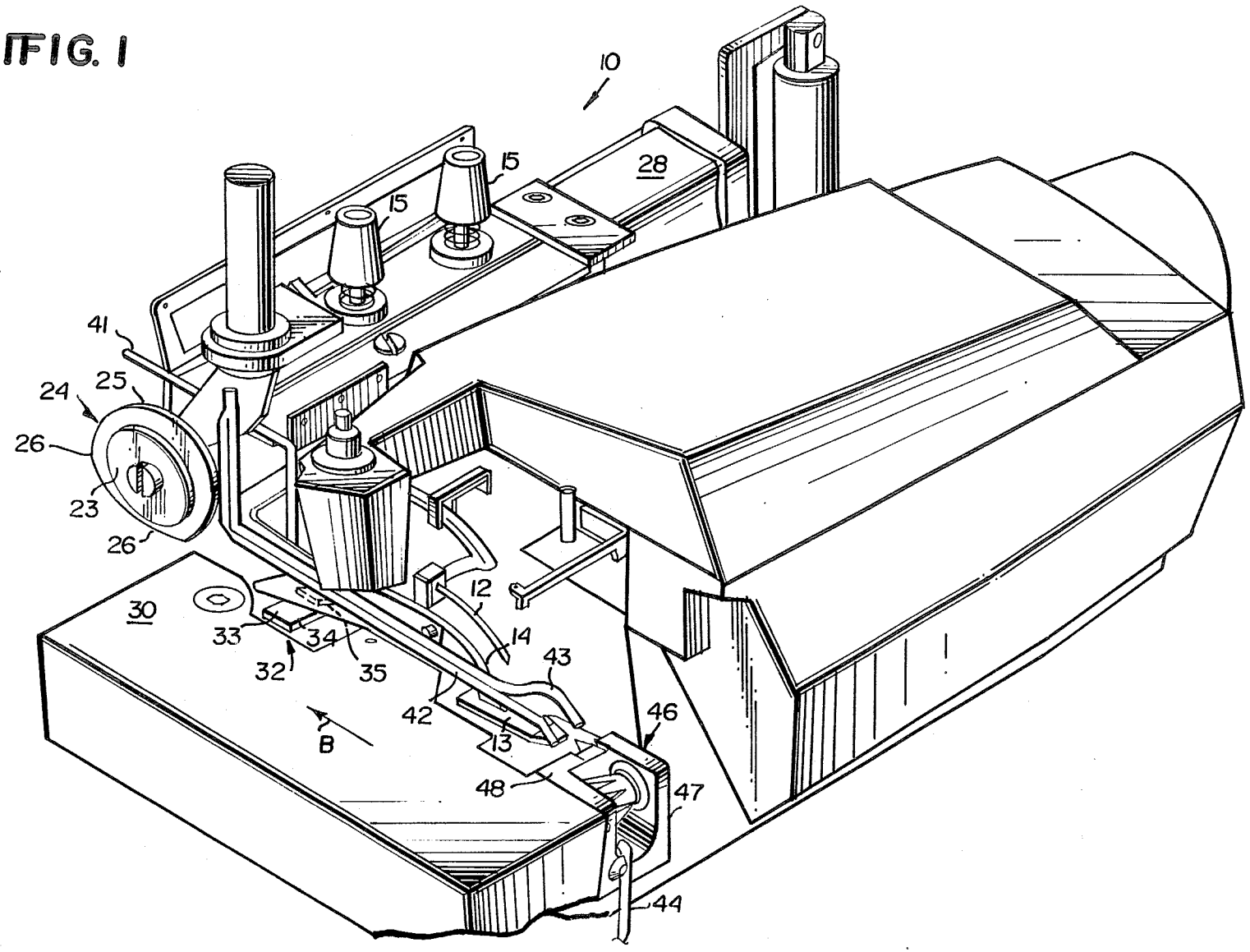
FIG. 1 is a top, front, perspective, detailed view of major operative components of the attachment according to the invention.

The conventional overedger type semi-automatic sewing machine is illustrated generally by reference numeral IO in FIG. 1. This machine conventionally has a tongue about 3/8 inch long, and a throat plate on the frame of the machine below a presser foot 13 mounted on linkage 14, stitching needle 12, thread spools 15, and like components. A power source (not shown), such as an electric motor, conventionally powers the machine 12. The electric motor is connected through a conventional clutch (not shown) to an actuating arm which is controlled by a foot pedal.

In conventional commercial practice, after one garment is stitched by a conventional semi-automatic sewing machine, when stitching is completed, the operator lets up on the foot pedal, which causes the clutch to be disengaged and the stitching action of the needle stopped. However, there is inherent time delay between the operator's activation of the foot pedal and the actual stopping of the stitching action, with the result that an excess stitch chain is produced. When the stitch chain is severed from the garment that has just been stitched, it normally will be provided as a free chain, or fibers, extending from the leading edge of the next garment to be stitched. This is unsightly, and unacceptable. Therefore the stitched chain either must be cut off manually, or, more desirably, stitched into the seam of the next garment.

According to the present invention, an attachment for the semi-automatic sewing machine 10 for performing the above desired operation, is provided. A first component of the entire attachment comprises means for sensing the completion of stitching by the sewing machine of a first garment by sensing a trailing portion of the first garment. The automatic sensing means preferably comprises an electric eye means mounted just downstream of the presser foot 13 and a light emitting and sensing electric eye apparatus mounted above, and in operative association with, the eye target.

A second component of the entire attachment comprises means for automatically engaging a first garment in response to the sensing means and moving the first garment away from the stitching needle 12 more quickly than the sewing machine stitches the thread chain, to pull excess thread chain extending past the trailing portion of the first garment out of engagement with the tongue, and relatively taut. The automatic engaging means according to the invention preferably comprises the wheel 24. The wheel 24 preferably is of rubber or other elastic material, where at least the garment engaging portions thereof are of rubber or the like. In particular, wheel 24 includes a generally circular arcuate circumferential portion 25, the arcuate extent of the portion 25 preferably about 270°, as illustrated in FIG. 1. Hub 23 mounts the wheel 24 on a shaft (not shown) which is powered by a rotary pneumatic cylinder 28, or a like power source for rotating the shaft. The axis about which the wheel 24 rotates is generally perpendicular to the direction of movement B of the garments through sewing machine 10.

The wheel 24 also has surface means, preferably cutouts or scalloped portions 26 extending over approximately 9O° of the circumference of the wheel. During operation of the wheel 24, which is spaced above the flat surface 30 of the sewing machine 10, when the circumferential portion 25 is above the surface 30, a garment between the portion 25 and surface 30 is engaged by the wheel 24 propelled in the direction B at the tangential velocity of the portion 25. Portion 25 is dimensioned so that its circumferential extent corresponds generally to the linear extent of a garment portion beneath so that the stitching chain will be held taut once the portion 25 is at the end of its rotation. The cylinder 28 rotates the shaft approximately 360°, however, and the surface means 26 are provided so that when they are above the surface 30 they do not engage the garment and no longer propel the garment. After completion of an operation cycle, the cylinder 28 rotates the wheel 24 back to its original position, as shown in FIG. 1.

Another component of the complete apparatus comprises the automatic severing means illustrated generally by reference numeral 32 in FIG. 1. Severing means 32 automatically severs the excess thread chain from the trailing portion of a first garment when the excess thread chain is relatively taut. Preferred severing means illustrated in the drawings comprises the stationary plate 33 flush with the surface 30, having an edge 34, and rotatable plate 35 having an edge which cooperates with the edge 34. Rotatable plate 35 is affixed to a shaft (not shown) and is rotatable therewith about an axis parallel to the direction B. A linear actuator, such as a piston and cylinder assembly may be utilized with appropriate linkage to rotate plate 35 a predetermined amount to effect severing of the thread chain.

The significant component of the attachment according to the invention disclosed in this continuation-in-part application includes means for automatically positioning the excess thread chain with respect to the second garment so that the excess thread chain is stitched into the seam of the second garment by the sewing machine 10. Such positioning means comprise four air jet conduits 41, 42, 43 and 44 connected to a source of air under pressure with conventional valving and timing mechanisms associated therewith, and an associated rotatable thread catcher wheel assembly generally indicated by reference numeral 46. A first air jet conduit 41, configured as illustrated in FIG. 4, is positioned to blow the thread chain, immediately after severing at 32, to the opposite side of the needle 12. Second and third air jet conduits 42, 43 extend parallel to the direction of garment movement B, and are positioned to engage the thread chain with the thread catcher wheel assembly 46 in a manner to be described in more detail below. A fourth air jet conduit 44 is positioned in front of the catcher wheel assembly to effect rotation thereof.

Referring particularly to FIGS. 2 and 3, the thread catcher wheel assembly 46 comprises a support block 47 which is adapted to be secured to the sewing machine frame so that its upper surface 48 is flush with machine surface 30. As can be seen most clearly in FIG. 3, the block 47 includes a substantially U-shaped recessed portion 49 and transversely oriented openings 50 and 51 which mount the rotatable thread catcher wheel 52. The wheel 52 comprises a conical or tapered peripheral surface 53 provided with a plurality of surface indentations 54, each of which having a substantially radially extending surface portion 55. At one end, the tapered wheel is provided with a relatively short cylindrical portion 56 which receives a serrated ring 57 which, in turn, is received within a recess 58 provided in a plastic bushing 59. The serrations extend generally parallel to the axis of rotation of said thread catcher wheel and lie on the outer circumferential surface of said ring. The wheel 52 is further provided with an axial through bore 60 for receiving a conventional one-way clutch bearing 61, the details of which are well understood by those skilled in the art and, therefore, need not be described further herein. The clutch bearing 61 receives an axle 62 which is mounted at one end in the bore 50 in the support block 47, and at the other end, in a bore 63 provided in the bushing 59. The wheel components are mounted within the support block such that one way clutch bearing 61 permits free rotation of wheel 52, axle 62, and serrated ring 57 in a clockwise direction only as viewed from the left in FIG. 1.

A braking mechanism is provided which regulates the force necessary to rotate the wheel. Referring specifically to FIG. 3, it may be seen that a groove 64 is provided in the axle at a point along the length of the axle which is supported in the block 47. A bearing member 65 is slidably received within a bore 66 provided in the block 47 and extending perpendicular to the axis of rotation of the wheel 52. Bearing member is adjustably biased into frictional engagement with the groove 64 by a small coil spring 67 and set screw 68. By turning the set screw 68, pressure on the axle 62 may be increased or decreased as desired to regulate the ease with which the wheel 52 is permitted to rotate.

The interaction of the four air jets and the thread catcher wheel assembly will now be described. An jet conduit 41 is utilized to supply a short burst of air under pressure to blow a severed thread chain from the cutting mechanism 32 in a direction opposite to the direction of garment movement B, and to a point adjacent the support block 47. Air jet conduit 42 is then actuated to blow the thread chain onto the wheel 52 and down the tapered surface 53 into engagement with the serrated ring 57. The third air jet conduit 43 supplies air under pressure to maintain the thread chain in engagement with the serrated ring 57 until it is snagged thereby. The fourth air jet conduit 44 supplies a burst of air under pressure onto the tapered wheel so as to impinge on radial surfaces 55 to cause the Wheel to rotate in a clockwise direction, as viewed in FIG. 1.

Rotation of wheel 52, and serrated ring 57, the speed of which is regulated by adjusting set screw 68, applies tension to the thread chain and maintains it in taut condition, so that the thread chain may be stitched into the seam of the next garment. During this subsequent stitching operation, the thread chain is gradually released, i.e., pulled away from, the now stationary serrated ring 57.

During operation of the machine, the actuation of the air jet conduits to supply air under pressure is timed to coordinate with the mechanical operations of the machine. For example, severing of the thread chain is accompanied by simultaneous actuation of the valve controlling air supply through conduit 41 for approximately 0.20 seconds. This is followed immediately by actuation of valves controlling air flow through conduits 42, 43 and 44 to effect catching and tensioning of the thread chain. Again, the air burst may be on the order of a 0.20 second pulse.

The operation of the machine is otherwise substantially as described in parent application Ser. No. 866,561, filed May 23, 1986, U.S. Pat. No. 4,679,515, and any disclosure in that application which is omitted from this application is incorporated by reference herein.

While the invention has been herein shown and described in what is presently conceived to be the most practical and preferred embodiment thereof, it will be apparent to those of ordinary skill in the art, that many modifications may be made therein within the scope of this invention, which scope is to be accorded the broadest interpretation of the appended claims so as to encompass all equivalent methods and products.

I claim:

1. An attachment for a semi-automatic sewing machine, having a stitching needle for stitching a thread chain, a presser foot, and a power source, comprising:

means for automatically sensing the completion of stitching, by the semi-automatic sewing machine, of a first garment, by sensing a trailing portion of the first garment;

means for automatically engaging the first garment in response to said sensing and moving the first garment away from the stitching needle more quickly than the sewing machine stitches the thread chain, to pull excess thread chain extending past the trailing portion of the first garment relatively taut;

means for automatically severing, on a first side of the stitching needle, the excess thread chain with respect to a second garment so that the excess thread chain is stitched to the second garment by the sewing machine; and means for automatically positioning the thread chain including: blowing means for blowing the thread chain from the position at which it is severed to a position on a second side of the stitching needle, opposite the first side; and rotary catching means for catching the thread chain at said position on the second side of the stitching needle and for gradually releasing the excess thread chain as it is stitched to the second garment.

2. An attachment as recited in claim 1 wherein said catching means maintains tension on said excess thread chain by frictionally engaging said excess thread chain, to gradually release it as it is stitched to the second garment.

3. An attachment as recited in claim 2 wherein said catching means comprises a rotatable wheel provided with a serrated ring, said wheel and ring being rotatable in one direction only.

4. An attachment as recited in claim 3 wherein said wheel and ring are components of a thread catcher wheel assembly which further comprises an axle, a one way clutch bearing mounted on said axle, said wheel mounted on said bearing, and said serrated ring mounted on one end of said wheel, said assembly being rotatably mounted in a support block attached to a frame portion of said machine.

5. An attachment as recited in claim 4 wherein said wheel is formed with a tapered peripheral surface provided with a plurality of surface indentations.

6. An attachment as recited in claim 4 wherein said axle is provided with an annular groove adjacent one end thereof, and said support block has mounted therein adjustable, spring-biased braking means for engaging said groove in said axle to thereby regulate the speed at which the wheel may rotate in said one direction.

7. An attachment as recited in claim 5 wherein means are provided for delivering air under pressure to impinge on said surface indentations and to thereby impart rotary motion to said wheel.

8. An attachment as recited in claim 1 wherein means are provided for supplying air under pressure to cause said thread chain to lie on said wheel and to slide downwardly into engagement with said serrated ring.

9. An attachment as recited in claim 7 wherein said means for supplying air under pressure-includes first means for blowing said thread chain onto said wheel and into engagement with said serrated ring, and second means for insuring that said thread chain remains on said wheel until it is snagged by said serrated ring.

10. A method of automatically stitching excess thread chain to a cloth so that no free stitches are provided on the leading edge of the cloth, utilizing a semi-automatic sewing machine having a stitching needle for stitching the thread chain, the method comprising the steps of:

(a) automatically sensing the completion of stitching, by the semi-automatic sewing machine, of a first cloth, by sensing a trailing portion of the first cloth;

(b) automatically engaging the first cloth in response to the sensing and moving the first cloth away from the stitching needle more quickly than the sewing machine stitches the thread chain, to pull excess thread chain extending past the trailing portion of the first cloth relatively taut;

(c) automatically severing on a first side of the stitching needle, the excess thread chain from the trailing poriton of the first cloth when the excess thread chain is relatively taut; and (d) automatically positioning the excess thread chain with respect to a second cloth so that the excess thread chain is stitched to the second cloth by the sewing machine, so neither cloth has free stitches extending therefrom, wherein step (d) is practiced by blowing the stitch chain from the position at which it is severed to a poriton on a second side of the stitching needle, opposite the first side, blowing the thread further onto a rotatable catching wheel, catching the thread chain at the position on the second side of the stitching needle, and gradually releasing the excess thread chain as t is stitched to the second cloth.

11. A method as defined in claim 10 wherein step (d) is further practiced by directing a pulse of air under pressure at said catching wheel to impart rotary movement thereto and to thereby exert tension on said excess thread chain.

12. An attachment for a semi-automatic sewing machine, having a stitching needle for stitching a thread chain, a presser foot, a thread servering means and a power source, comprising:

means for positioning any excess thread chain extending from a trailing edge of an article which has just been stitched by the sewing machine after severing of the excess thread chain from the article, said positioning means comprising:

blowing means for blowing said stitch chain from the position at which it is severed to a position on an upstream, first side of the stitching needle;

rotary catching means for catching the thread chain at said position on the upstream side of the stitching needle and maintaining tension on said excess thread chain by frictionally engaging it, and for permitting the gradual release of such thread chain as it is being stitched to another garment.

13. An attachment as defined in claim 12 wherein said rotary catching means comprises a freely rotatable wheel assembly including an axle, a sleeve bearing mounted on said axle, a tapered air wheel mounted on said bearing and including a cylindrical end surface for receiving a serrated ring, said assembly mounted for rotation in a frame portion of said machine, said catching means also including first air supply means for directing air under pressure to cause said thread to lie on said wheel, second air supply means for directing air under pressure to maintain said thread on said wheel until it is snagged by said serrated ring, and third air supply means for directing air under pressure to impart rotary motion to said wheel and said serrated ring.

14. A thread catcher attachment for a semi-automatic sewing machine having a stitching needle, wherein said stitching needle is utilized to stitch an excess chain thread from a first garment into a seam of a second garment, said attachment comprising:

rotatable means, rotatable about an axis, for engaging an excess thread chain; and thread chain snagging means provided on said rotatable means, comprising a serrated ring having serrations on its outside circumference extending generally parallel to said axis of rotation.

15. An attachment as defined in claim 14 wherein said rotatable means comprises a wheel provided along substantially its entire length with a tapered peripheral surface.

16. An attachment as defined in claim 15 wherein said tapered peripheral surface extends from a larger diameter portion of said wheel to a smaller diameter portion of said wheel, said serrated ring mounted on said wheel adjacent the smaller diameter portion thereof.

17. An attachment as defined in claim 14 further comprising means for blowing said thread chain into engagement with said thread chain snagging means; and wherein said surface of said wheel is formed with a plurality of recessed portion which cooperate with said blowing means to effect rotation of said wheel.

18. An attachment as defined in claim 17 wherein said means for blowing includes a first air jet conduit for supplying air under pressure to blow said excess chain thread toward said rotatable means, second and third air jet conduits for supplying air under pressure to blow said excess chain thread into engagement with said snagging means, and a fourth air jet conduit for supplying air under pressure to said wheel to effect rotation thereof and to thereby tension said excess chain thread.

19. An attachment as defined in claim 14 wherein said wheel and serrated ring are received on a one-way clutch bearing supported by an axle mounted for rotation in a support block, such that said wheel and said ring are rotatable in one direction.

20. An attachment as defined in claim 19 and further including adjustable braking means extending between said support block and said axle for regulating the speed of rotation of the wheel and serrated ring.

* * * * *